United States Patent [19]

Vishwanath

[11] Patent Number: 4,708,635

[45] Date of Patent: Nov. 24, 1987

[54] PULSE COMBUSTION APPARATUS AND METHOD

[75] Inventor: Palamadi S. Vishwanath, Brunswick, Ohio

[73] Assignee: American Gas Association, Cleveland, Ohio

[21] Appl. No.: 916,405

[22] Filed: Oct. 7, 1986

[51] Int. Cl.[4] ..... F23C 11/04

[52] U.S. Cl. ..... 431/1; 431/285; 60/39.77

[58] Field of Search ..... 431/1, 158, 285; 60/39.76, 39.77; 122/24

[56] References Cited

U.S. PATENT DOCUMENTS

| | | | |
|---|---|---|---|
| 2,715,436 | 8/1955 | Lafferentz et al. | 431/1 |
| 2,911,957 | 11/1959 | Kumm | 431/1 X |
| 3,194,295 | 7/1965 | Marchal et al. | 431/158 |
| 3,267,986 | 8/1966 | Olsson | 431/1 |
| 3,880,568 | 4/1975 | Melton | 431/1 |
| 4,473,348 | 9/1984 | Tikhonovica et al. | 431/1 |
| 4,595,356 | 6/1986 | Gaysert et al. | 431/1 X |

FOREIGN PATENT DOCUMENTS

| | | | |
|---|---|---|---|
| 2209 | of 1908 | United Kingdom | 60/39.77 |

*Primary Examiner*—Margaret A. Focarino

*Attorney, Agent, or Firm*—Pearne, Gordon, McCoy & Granger

[57] ABSTRACT

The pulsed combustion gases of a primary burner having a low fuel input rate are combined with those of a main burner having a high fuel input rate to provide an integrated combustion process having a single pulse frequency and improved stability. The combustion gases of the primary burner are used to start the main burner by inducing the self-feeding of an air and fuel mixture into the main burner and igniting the mixture.

32 Claims, 3 Drawing Figures

PULSE COMBUSTION APPARATUS AND METHOD

BACKGROUND OF THE INVENTION AND PRIOR ART

The invention relates to combustion heating. More particularly, the invention relates to pulse combustion heating apparatus and methods wherein primary and main burners are arranged in fluid communication to provide a combustion system having pulse operating characteristics derived from the combination of the two burners.

In the pulse combustion burners of the Helmholtz type, an oscillating or pulsed flow of combustion gases through the burner is maintained at a frequency determined by burner component geometry and fuel supply characteristics, including the mixing of components thereof. Typically, a combustion chamber of a given size cooperates with a tailpipe or exhaust pipe of specific dimensions to provide explosive combustion cycles, thermal expansion of the combustion gases, and oscillating gas pressures which provide the pulsed flow of combustion gases through the burner. In order to make the pulse combustion process self-sustaining, the oscillating gas pressures may be used to provide self-feeding of a combustible gaseous mixture which generally comprises air and a gaseous fuel such as natural gas.

The operation and stability of pulse combustion burners are dependent upon the burner geometry and the degree of air and fuel mixing as indicated. Also, the ease of initiating ignition and maintaining stable operation are affected by these factors. Accordingly, pulse combustion burners are not readily amenable to operating over a wide turndown ratio. The turndown ratio in a typical pulse combustion burner is in the range of 15% to 35% of its designed fuel energy input rate. If the input rate is reduced below a minimum operating value, the process stability self-decays as reduced operating pressures result in correspondingly reduced fuel input rates until burner shutdown occurs. In a somewhat related manner, air and/or fuel supply variations may cause significant changes in the operation of the burner, including burner shutdown.

The close dependency between pulse combustion operation and burner geometry also makes scaling difficult. Presently, scaling is substantially a trial and error process based in part upon empirically developed relationships and data developed in respect to the particular scaling application. Scaling is increasingly more difficult as the absolute value of the fuel input rate increases. Thus, it is significantly more difficult to scale-up by a factor of five a 1,000,000 BTU/hr. burner as compared with a 100,000 BTU/hr. burner.

U.S. Pat. No. 3,194,255 to Marchal et al. discloses a system wherein a resonant burner exhausts into a non-resonant burner to cause periodic combustion of gases in the non-resonant burner. The exhaust gases of the non-resonant burner are directed into an optional final or tail burner. Another mixed burner system is disclosed in U.S. Pat. No. 4,473,348 to Tikhonovich et al. In this patent, a continuous auxiliary burner exhausts its combustion products into a main burner between the feed pulses to smooth out the combustion in the main burner.

SUMMARY OF THE INVENTION

In accordance with the present invention, primary and main combustion processes are combined to provide an integrated combustion process having attributes of each of the combined processes. The primary and main combustion processes are in fluid communication and a single combined combustion process is obtained.

In the disclosed embodiments, primary and main burners arranged to self-feed fuel at different input rates are combined to provide an integrated combustion process characterized by a single operating frequency and significantly improved stability and ignition reliability. The combustion gases from the primary burner flow into the main burner wherein any noncombusted gases are burned together with the air and fuel fed into the main burner. (As used herein, "combustion gases" contemplates both combustion products and combustible gases including any air and fuel which has not yet been burned.)

The primary burner is generally of a much smaller heating capacity than the main burner. For example, the primary burner may have a fuel input rate of 100,000 BTU/hr. and the main burner may have a fuel input rate of 1,000,000 BTU/hr. The primary burner provides desired operational and control characteristics, while the main burner provides the major heating capacity.

The primary burner, because of its relatively smaller size, enjoys more reliable ignition than the main burner. Similarly, because of the smaller size of the primary burner, the air and fuel streams tend to mix more thoroughly, leading to improved burner stability characterized by more uniform combustion and less sensitivity to fuel and heat load variations. These advantages are imposed upon the main burner by the integrated apparatus and process of the present invention.

The primary burner is initially started and allowed to reach a stable operating condition. The main burner is then turned on and the oscillating pressures provided by the primary burner are used to initiate start-up and self-feeding of the air and fuel mixture into the main burner. The hot gases from the primary burner also provide ignition of the combustible gaseous mixture which is self-feeding into the main burner. In this manner, the reliability of ignition of the smallersized primary burner is enjoyed by the main burner.

Reliable ignition is particularly important in the safe operation of large size burners (e.g., 1,000,000 BTU/hr. input rates), since several cubic feet of gaseous fuel may quickly accumulate within the burner upon ignition failure. In addition to provide more reliable ignition, the primary burner also serves to burn gaseous fuel as it becomes available within the burner for any reason and thereby avoids dangerous fuel accumulations.

The primary burner also serves to stabilize the operation of the main burner as compared with a similarly sized burner not having an associated primary burner. The frequency of the primary burner will tend to be followed by or imposed upon the main burner. This is believed to be associated with the tendency of the primary burner to minimize pressure amplitude variations occurring during steady state operation. This also tends to minimize frequency variations and to increase the overall peak operating pressure and the operating frequency. Experience has shown that the higher peak pressures and frequencies provide improved stability and increased heat transfer.

The stability of the operation of the main burner is improved by the higher operating pressure and frequency and minimization of variation of pressure amplitude. For example, the main burner will be less responsive to variations in the air and/or fuel supply, and continued operation may be sustained despite fuel supply interruptions which would have previously shut down the main burner. In extreme cases, a shutdown of the main burner due to a significant temporary interruption of the main fuel supply results in automatic re-ignition by the primary burner once the main fuel supply is restored.

The turndown ratio of the main burner is also significantly increased by the primary burner. Depending upon the relative sizes of the primary and main burners, the turndown ratio may be 100% with full shutdown of the main burner. In the case of a 10:1 size ratio between the main and primary burners, turndown ratios in the range of 60% to 100% of the main burner fuel input rate have been achieved.

It should be appreciated also that burner operation may be maintained at an input rate which exceeds the designed rate. Typical prior art burners may actually display an operating range around the designed input rate equal to from ±15% to ±35% of the designed rate. The primary burner herein also provides improvements in respect to the increased input rates. Thus, the operating range of a combined burner apparatus having a 10:1 main to primary burner size ratio is in the range of ±60% to 100% of the main burner input rate.

The primary and main burner combination in accordance with the invention also facilitates the scaling of burners. A first major advantage in scale-up is the improved ignition reliability obtained upon usage of the primary burner to ignite the main burner. The improvements in operating stability resulting from reduced pressure amplitude variations as discussed above also provide enlarged pressure and frequency tolerance ranges upon scale-up. Accordingly the main burner may be more reliably scaled-up using known mathematical techniques. Similarly, the primary burner is also scaled-up more reliably with the further guidance of the size proportions in the existing burner and the benefit of scaling at comparatively lower fuel input rates.

In certain scaling applications, it may be possible to maintain the frequency of an existing known primary and main burner combination in the scaled apparatus with limited changes. For example, the scaled apparatus may require changes in the tailpipe area to handle increased gas flows, and the increased combustion chamber volume may be calculated directly from the Helmholtz equation in view of the constant frequency. Thus, the existing combination need only be scaled to meet the frequency-matching relationship, and the Helmholtz equation may be used to approximate the combustion chamber size based upon an existing frequency and the tailpipe area.

DETAILED DESCRIPTION OF THE DRAWINGS

Figure 1:
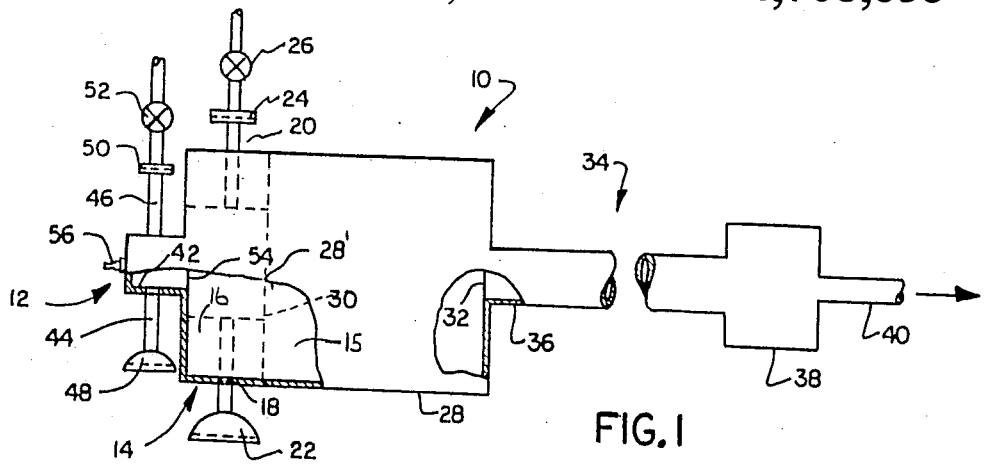
FIG. 1 is a diagrammatic, elevational view of a pulse combustion apparatus having a primary and a main burner in accordance with the invention.

Referring to FIG. 1, there is shown a pulse combustion apparatus 10 including a primary burner 12 and a main burner 14. Gas flow through the apparatus 10 is from left to right, as shown in FIG. 1.

The main burner 14 includes a chamber 15 having a mixer head portion 16 adjacent its forward end. As shown in solid line in FIG. 1, the mixer head 16 may be of the same lateral or diametrical dimensions as the adjacent portion of the chamber 15 and merely comprise a region thereof. Alternatively, the mixer head 16 may be of reduced lateral or diametrical dimensions as compared with the chamber 15, as shown in dotted line in FIG. 1. In either case, the mixer head 16 may be provided with a generally cylindrical configuration.

The mixer head 16 is connected to an air supply line 18 and a fuel supply line 20. The lines 18 and 20 respectively include flapper valves 22 and 24 which allow one-way flow and self-feeding of a combustible gaseous mixture to the mixer head 16 in a known manner. The fuel line 20 also includes a valve 26 for regulating the flow of fuel to the mixer head 16 and operating the main burner 14 at variable input rates over a predetermined turndown ratio.

The main burner 14 also includes a combustion chamber 28 which comprises the remaining region or portion of the chamber 15 located downstream of the mixer head 16. The combustion chamber 28 defines a passageway for the flow of combustion gases through the apparatus. To that end, the combustion chamber 28 includes an inlet opening 30 for receiving combustion gases from the mixer head 16 and an outlet opening 32 for passing the combustion gases to an exhaust system 34.

The exhaust system 34 includes a tailpipe or exhaust pipe 36 which receives the combustion gases from the chamber 28 and conveys them to a decoupler 38. The decoupler 38 comprises a vessel having a relatively large volume for isolating the pulse combustion process from downstream pressure variations as the combustion gases are discharged through a vent pipe 40. The use of the decoupler 38 is optional and the tailpipe 36 may be directly connected to the vent pipe 40.

The primary burner 12 includes a mixer head 42 which has a generally cylindrical configuration. An air supply line 44 and a fuel supply line 46 are respectively provided with flapper valves 48 and 50 to provide self-feeding of a combustible gaseous mixture to the mixer head 42. A valve 52 is provided in the fuel line 46 for independent control of the fuel supply and regulation thereof over the turndown ratio of the primary burner 12.

The primary burner 12 also includes a combustion chamber 28' corresponding with the chamber 15 and comprising the mixer head 16 and the combustion chamber 28. To that end, the mixer head 42 communicates with the chamber 15 and mixer head 16 at an opening or common boundary indicated at 54. The volume of the combustion chamber 28 is typically much greater than that of the mixer head 16 and, for convenience, the primary burner 12 may be considered to have a common combustion chamber with the main burner 14.

As shown, both the primary and main burners are axially aligned along a common longitudinal axis. Thus, the openings 54, 30 and 32 are also aligned and cooperate to facilitate the pulsed flow of gases and explosive combustion cycles at a single frequency.

For operation of the pulse combustion apparatus 10, the primary burner 12 is initially started and allowed to reach stable operation. To that end, the burner 12 includes a sparekplug 56 for ignition of the combustible gaseous mixture delivered to the mixer head 42 during start-up. Similarly, a blower (not shown) may be operably connected to the air supply line 44 to deliver pressurized air to the burner 12 during start-up. Once stable operation is established, the operation of the sparkplug and the blower is discontinued. During stable operation, the primary burner 12 self-feeds an air and fuel mixture through lines 44 and 46 in accordance with the alternating positive and negative pressures existing within the burner. The combustion of the air and fuel mixture is initiated in the mixer head 42 and completed within the combustion chamber 28'.

The volume of the combustion chamber 28' is significantly larger than that which would be associated with the input rate of the primary burner 12 in accordance with prior art technology. Therefore, the operating pressures within the primary burner 12 are lower than those which would be developed in a similarly sized prior art pulse combustion burner. The relatively lower operating pressures provide desired air and fuel flows due to appropriate increases in the size and resulting flows through air and fuel supply components, including flapper valves 48 and 50. The lower operating pressure results in a minimal flow of air through line 18, which may be readily accommodated by operating the burner 12 with a slight excess of fuel input.

The main burner 14 may be turned on once stable pulse combustion operation has been established in the primary burner 12. To that end, the valve 26 may be opened to allow the flow of a gaseous fuel through the line 20. The flapper valves 22 and 24 allow one-way flow of air and fuel in response to the alternating positive and negative pressures developed by operation of the primary burner 12. The hot combustion gases from the mixer head 42 ignite the combustible gaseous mixture delivered into the mixer head 16 via lines 18 and 20. Accordingly, the main burner 14 does not require a separate sparkplug or air blower, since the primary burner 12 provides both ignition and self-feeding during start-up. Once stable operation is established in respect to the main burner 14, it may be considered to provide its own self-feeding and self-exhausting functions, since the operation of the primary burner 12 may be discontinued.

The simultaneous operation of burners 12 and 14 results in an integrated combustion process in the apparatus 10 which is affected by combustion processes in each of the burners. The apparatus 10 develops an overall input rate and heating capacity slightly greater than the sum to be expected by the separate operation of the primary and main burners. For example, if separate operation of primary burner 12 and main burner 14 respectively provides input rates of 100,000 and 1,000,000 BTU/hr., the input rate of the burner 12 may increase to 200,000 BTU/hr. upon combined simultaneous operation with the burner 16, which maintains a 1,000,000 BTU/hr. input rate.

The improvements in operation are believed to be related to the observed tendency of the primary burner to minimize pressure amplitude variations during steady state operation. This, in turn, tends to minimize frequency variations and to provide an overall higher operating frequency. The pulse combustion process within the apparatus 10 therefore enjoys both more consistent pressure amplitude variations of larger magnitude and higher operating frequencies which cooperatively enhance self-feeding of the air and fuel as well as the mixing thereof to provide a uniform combustible gaseous mixture.

Figure 2:
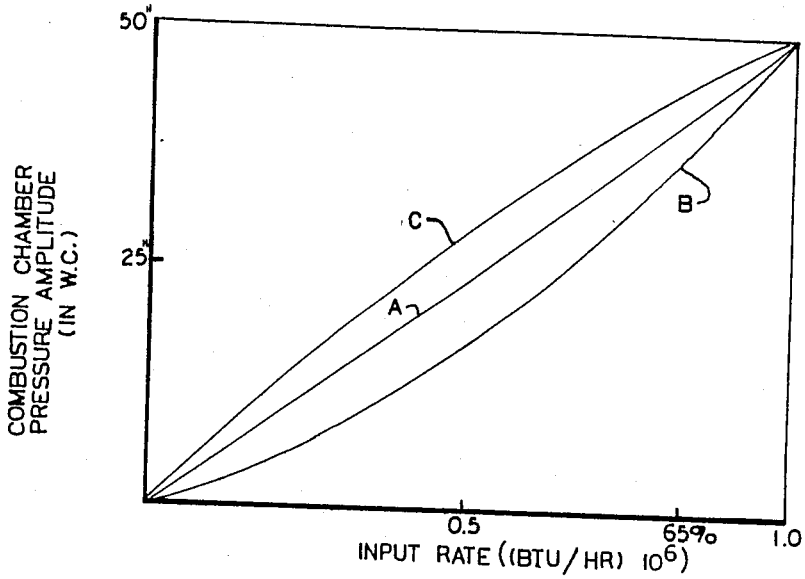
FIG. 2 is a graph showing the amplitude of the pressure oscillations in the combustion chamber required for self-feeding air and fuel at various energy input rates and operating curves for a prior art burner and for an apparatus in accordance with the invention.

Referring to FIG. 2, curve A shows the calculated theoretical amplitude of the pressure oscillations in the combustion chamber required for self-feeding air and fuel at various energy input rates. Curve B represents an operating curve for a prior art burner designed to have a 1,000,000 BTU/hr. input rate. As shown, the prior art burner will develop sufficient pressure oscillations at the designed input rate to provide self-feeding of a combustible gaseous mixture. As the input rate is decreased, the corresponding pressure amplitudes also decrease. The reduction of input rate may be the result of throttling the fuel supply to the burner over the range of its turndown ratio. In spite of inadequate pressures at lower input rates, prior art burners have been found to maintain reasonably stable operation at input rates ranging between 65% and 85% of the designed burner rate. At greater turndown ratios and lower input rates, prior art burners tend to rapidly shut down, since insufficient pressure is being developed to self-feed the fuel mixture. The shutdown is rapid since the already low pressure for a given cycle results in a reduced amount of fuel being fed and an even lower pressure upon combustion of such fuel in the next cycle.

Curve C represents the operating curve for a burner designed to have a 1,000,000 BTU/hr. input rate in accordance with the present invention. As indicated in FIG. 2, curve C lies above curve A in accordance with the improved stability of operation, including increased operating frequencies and pressures. This also results in an increased turndown ratio capability. This is effected in apparatus 10 by operation of the valve 26 to throttle the supply of fuel to the main burner 14.

Figure 3:
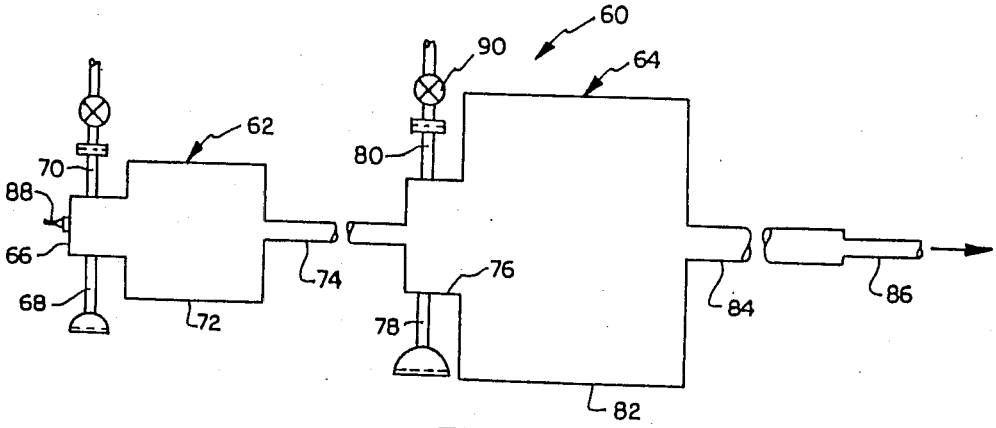
FIG. 3 is a diagrammatic view, similar to FIG. 1, showing another embodiment of a combustion apparatus in accordance with the invention.

Referring to FIG. 3, a pulse combustion apparatus 60 in accordance with a second embodiment of the invention is shown. The apparatus 60 includes a primary pulse combustion burner 62 and a main pulse combustion burner 64. The burners 62 and 64 are in fluid communication, the combustion gases from the burner 62 passing into the burner 64.

The primary burner 62 includes a mixer head 66 having inlet lines 68 and 70, respectively arranged for the self-feeding of air and fuel through in-line flapper valves. The burner 62 also includes a combustion chamber 72 connected to a tailpipe 74.

The main burner 64 includes a mixer head 76 which is connected to the tailpipe 74 for receipt of the exhaust gases from the primary burner 62. The mixer head 76 also receives a combustible gas mixture via air supply line 78 and fuel supply line 80. The supply lines 78 and 80 are arranged for self-feeding of the air and fuel through the use of flapper valves in response to pressure oscillations within the mixer head 76.

The main burner 64 also includes a combustion chamber 82 which receives combustion gases from the mixer head 76. The combustion gases pass from the chamber 82 into a tailpipe 84 and they are subsequently discharged through a vent pipe 86.

The operation of the pulse combustion apparatus 60 is similar to that of the apparatus 10. To that end, the primary burner 62 is initially started with the use of a sparkplug 88 and a blower (not shown) connected to the air line 68. Once stable operation is achieved, the sparkplug and blower are no longer required.

The operation of the main burner 64 is commenced by opening valve 90 in fuel line 80 and a corresponding valve in the airline 78 to allow self-feeding of an air/fuel mixture in response to the pressure oscillations provided by the primary burner 62. The fuel/air mixture is ignited by the hot exhasut gases entering the mixer head 76 from the tailpipe 74. The valve 90 may be used to throttle the flow of gas through line 80 in order to provide a turndown ratio for the apparatus 60.

The burners 62 and 64 provide an integrated combustion process within the apparatus 60 with changes in the operation of either burner affecting the operation of the other burner and the overall combustion process. The burners 62 and 64 are designed to operate at the same frequency, with the burner 62 providing operational stability, reliability of ignition, and increased turndown ratio in the same manner as in the first embodiment. The burner 64 has a relatively higher fuel input rate and provides the majority of the heating capacity of the apparatus 60.

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention. Accordingly, the patent is not to be limited in scope and effect to the specific embodiments herein shown and described nor in any other way that is inconsistent with the extent to which the progress in the art has been advanced by the invention.

What is claimed is:

1. A pulse combustion apparatus wherein explosive combustion cycles provide gas pressure oscillations comprising a primary burner means operably connected to a main burner means to flow combustion gases from said primary to said main burner means, fuel supply means for self-feeding a combustible gaseous mixture of each of said primary and main burner means, combustion chamber means for pulse combustion of said combustible gaseous mixture to provide combustion gases, and exhaust means for self-exhausting said combustion gases from said apparatus, each of said burner means being separately operable after start-up to provide self-sustaining pulse combustion of said combustible gaseous mixture, said burner means also being simultaneously operable with said combustion chamber means and exhaust means cooperating to provide resonant combustion of combustible gaseous mixtures in each of said burner means at substantially the same frequency of pressure oscillations for self-feeding said combustible gaseous mixture and self-exhausting said combustion gases in accordance with said pressure oscillations.

2. An apparatus according to claim 1, wherein said primary burner means cooperates with said fuel supply means to provide a flow of said combustible gaseous mixture to said main burner means during start-up of the main burner means.

3. An apparatus according to claim 2, wherein combustion gases from said primary burner means provide ignition of said combustible gaseous mixture in said main burner means during start-up.

4. An apparatus according to claim 3, wherein said combustion chamber means includes a common chamber for combustion of combustible gaseous mixture supplied to each of said burner means.

5. An apparatus according to claim 4, wherein each of said burner means includes a mixer head for receiving combustible gaseous mixture from said fuel supply means, and said primary burner mixer head includes an outlet opening into said main burner mixer head.

6. An apparatus according to claim 5, wherein said main burner mixer head includes an outlet opening into said common chamber.

7. An apparatus according to claim 6, wherein said burner mixer heads and common chamber are aligned along a central axis.

8. An apparatus to claim 3, wherein said primary and main burner means respectively include a primary and a main mixer head, each of said mixer heads being adapted to receive combustible gaseous mixture from said fuel supply means, said combustion chamber means includes a primary and a main combustion chamber respectively associated with said primary and main mixer heads for combustion of combustible gaseous mixture fed into the mixer heads, and said exhaust means includes a primary and a main tailpipe respectively associated with said primary and main combustion chambers for receiving combustion gases from the combustion chambers, said primary tailpipe being connected to said main mixer head, and said main tailpipe discharging said combustion gases from said apparatus.

9. An apparatus according to claim 3, wherein said primary burner means is sized to have a primary fuel input rate, said main burner means is sized to have a main fuel input rate, said main fuel input rate being higher than said primary fuel input rate, and said main burner means also includes valve means to regulate the flow of combustible gaseous mixture to said main burner means and the turndown ratio of said apparatus, said primary burner means reducing the frequency and pressure amplitude variations in said main burner means as compared with a similarly sized burner not including a primary burner means whereby said turndown ratio of said apparatus is larger than it would be in such similarly sized burner not including primary burner means.

10. A pulse combustion apparatus comprising a primary burner, a main burner, fuel supply means for self-feeding of a combustible gaseous mixture to each of said burners, combustion chamber means for pulse combustion of said combustible gaseous mixture to provide combustion gases, and exhaust means for self-exhausting combustion gases from said apparatus, said primary burner being operable connected to said main burner to flow combustion gases from the primary burner into the main burner, each of said burners being separately operable after start-up to provide self-sustaining pulse combustion of said combustible gaseous mixture, said burner means also being simultaneously operable with said combustion chamber means and exhaust means cooperating to provide resonant explosive combustion cycles and gas pressure oscillations in each of said burners at substantially the same frequency for self-feeding said combustible gaseous mixture and self-exhausting said combustion gases in accordance with said pressure oscillations.

11. An apparatus according to claim 10, wherein aid primary burner is arranged to start before said main burner to provide pressure oscillations for causing said fuel supply means to provide a flow of combustible gaseous mixture to said main burner during start-up of the main burner, and said primary burner is arranged to ignite said combustible gaseous mixture in said main burner by contact with combustion gases from said primary burner.

12. An apparatus according to claim 11, wherein said combustion chamber means includes a common chamber for combustion of combustible gaseous mixture supplied to each of said burners.

13. An apparatus according to claim 12, wherein each of said burners includes a mixer head for receiving combustible gaseous mixture from said fuel supply means, said primary mixer head includes an outlet opening into said main mixer head, and said main mixer head includes an outlet opening into said common chamber.

14. An ignition and a stabilizer system for a main pulse combustion burner comprising a primary pulse combustion burner operably connected to flow combustion gases from said primary burner into said main burner, fuel supply means for self-feeding a combustible gaseous mixture to said main burner in response to gas pressure oscillations, and combustion chamber means and exhaust means to provide resonant explosive combustion of said combustible gaseous mixture and gas pressure oscillations in each of said burners, said primary burner being arranged to start before said main burner to provide gas pressure oscillations for causing said fuel supply means to provide a flow of combustible gaseous mixture to said main burner during start-up and to ignite said combustible gaseous mixture in said main burner by contact with combustion gases from the primary burner, said primary burner having a smaller heating capacity than said main burner and thereby improving the reliability of ignition of the main burner.

15. A system according to claim 14, wherein said primary burner is sized to have a primary fuel input rate and said main burner is sized to have a main fuel input rate, each of said burners being separately operable after start-up to provide self-sustaining pulse combustion of said combustible gaseous mixture at their respective fuel input rates, and said burners are simultaneously operable at a total fuel input rate greater than the sum of said primary and main fuel input rates.

16. A system according to claim 14, wherein said combustion chamber means includes a common chamber.

17. A system according to claim 16, wherein each of said primary and main burners includes a mixer head, and said primary burner mixer head includes an outlet opening into said main burner mixer head.

18. A system according to claim 17, wherein said main burner mixer head is a region of said common chamber.

19. A system according to claim 15, wherein said resonant explosive combustion and gas pressure oscillations occur in each of said burners at substantially the same frequency as determined by the frequency of operation of said primary burner.

20. A system according to claim 19, wherein said primary burner reduces frequency and pressure amplitude variations in said main burner during steady state operation as compared with a similarly sized burner not including a primary burner.

21. A method of pulse combustion wherein explosvie combustion cycles provide gas pressure oscillations comprising the steps of:

(a) providing primary and main burner means operably connected for fluid flow therebetween;

(b) self-feeding a combustible gaseous mixture to each of said burner means;

(c) combusting said combustible gaseous mixture in each of said burner means with explosive combustion cycles to provide combustion gases, each of said burner means being separately operable after start-up to provide self-sustaining pulse combustion of said combustion gaseous mixture; and (d) self-exhausting combustion gases from each of said burner means and flowing combustion gases from said primary burner means into said main burner means to provide an integrated pulse combustion process in said burner means at substantially the same frequency of pressure oscillations within each of said burner means.

22. A method according to claim 21, including the steps of starting said main burner means by self-feeding combustible gaseous mixture into the main burner means in response to the pressure oscillations of said primary burner means and igniting the combustible gaseous mixture in said main burner means by contact with the combustion gases from said primary burner means.

23. A method according to claim 22, wherein said primary and main burner means include a common combustion chamber and separate mixer heads, step (b) includes self-feeding combustible gaseous mixture into each of said mixer heads, and step (d) includes flowing combustion gases from said primary mixer head into said main mixer head.

24. A method according to claim 22, wherein each of said primary and main burner means respectively includes a mixer head for receiving and beginning the combustion of combustible gaseous mixture to provide combustion gases, combustion chamber means for receiving combustion gases from the mixer head and completing the combustion thereof, and exhaust means for removing said combustion gases from said combustion chamber, and step (d) includes flowing combustion gases from said primary exhaust means into said main mixer head and venting combustion gases from said main exhaust means to the atmosphere.

25. A method according to claim 21, wherein said burner means respectively have primary and main fuel input rates, and step (b) includes self-feeding combustible gaseous mixture into said main burner means at a higher rate than the self-feeding of combustible gaseous mixture into said primary burner means.

26. A method according to claim 25, wherein said main burner means include valve means to regulate the flow of combustible gaseous mixture to said main burner means and the turndown ratio of the burner means, said turndown ratio of said burner means being larger than it would be in a similarly sized burner not including primary burner means.

27. A method according to claim 21, wherein step (c) includes operating said primary burner means at a preselected frequency which is followed by the main burner means whereby the primary burner means stabilizes the operation of the main burner means.

28. A method according to claim 22, wherein said primary burner means has a smaller heating capacity than said main burner means whereby the reliability of starting the main burner is improved.

29. A method according to claim 22, wherein the primary burner means is sized to have a primary fuel input rate and said main burner means is sized to have a main fuel input rate, and step (d) includes self-feeding said combustible gaseous mixture to said primary and main burner means at a total fuel input rate greater than the sum of said primary and main fuel input rates.

30. A pulse combustion apparatus wherein explosive combustion cycles provide gas pressure oscillations comprising a primary burner means operably connected to a main burner means to flow combustion gases from said primary to said main burner means, fuel supply means for self-feeding a combustible gaseous mixture to said burner means, combustion chamber means for pulse combustion of said combustible gaseous mixture to provide combustion gases, and exhaust means for self-exhausting said combustion gases from said apparatus, said combustion chamber means and exhaust means cooperating to provide resonant combustion of combustible gaseous mixtures in each of said burner means at substantially the same frequency of pressure oscillations for self-feeding said combustible gaseous mixture and self-exhausting said combustion gases in accordance with said pressure oscillations, said primary burner means cooperating with said fuel supply means to provide a flow of said combustible gaseous mixture to said main burner means during start-up of the main burner means and to ignite said combustible gaseous mixture in said main burner means during start-up, said combustion chamber means including a common chamber for combustion of combustible gaseous mixture supplied to each of said burner means.

31. A pulse combustion apparatus comprising a primary burner, a main burner, fuel supply means for self-feeding of a combustible gaseous mixture to each of said burners, combustion chamber means for pulse combustion of said combustible gaseous mixture to provide combustion gases, and exhaust means for self-exhausting combustion gases from said apparatus, said primary burner being operably connected to said main burner to flow combustion gases from the primary burner into the main burner, said combustion chamber means and exhaust means cooperating to provide resonant explosive combustion cycles and gas pressure oscillations in each of said burners at substantially the same frequency for self-feeding said combustible gaseous mixture and self-exhausting said combustion gases in accordance with said pressure oscillations, said primary burner being arranged to start before said main burner to provide pressure oscillations for causing said fuel supply means to provide a flow of combustible gaseous mixture to said main burner during start-up of the main burner, said primary burner also being arranged to ignite said combustible gaseous mixture in said main burner by contact with combustion gases from said primary burner, and said combustion means including a common chamber for combustion of combustible gaseous mixture supplied to each of said burners.

32. An ignition and a stabilizer system for a main pulse combustion burner comprising a primary pulse combustion burner operably connected to flow combustion gases from said primary burner into said main burner, fuel supply means for self-feeding a combustible gaseous mixture to said main burner in response to gas pressure oscillations, and combustion chamber means and exhaust means to provide resonant explosive combustion of said combustible gaseous mixture and gas pressure oscillations in each of said burners, said primary burner being arranged to start before said main burner to provide gas pressure oscillations for causing said fuel supply means to provide a flow of combustible gaseous mixture to said main burner during start-up and to ignite said combustible gaseous mixture in said main burner by contact with combustion gases from the primary burner, said combustion chamber means including a common chamber. for combustion of combustible gaseous mixture supplied to each of said burners.

* * * * *